US007957687B2

(12) United States Patent
Ito

(10) Patent No.: US 7,957,687 B2
(45) Date of Patent: Jun. 7, 2011

(54) IMAGE FORMING APPARATUS AND CONVEYANCE MALFUNCTION DECISION METHOD

(75) Inventor: Mitsuhiro Ito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 699 days.

(21) Appl. No.: 11/759,511

(22) Filed: Jun. 7, 2007

(65) Prior Publication Data

US 2007/0286656 A1 Dec. 13, 2007

(30) Foreign Application Priority Data

Jun. 8, 2006 (JP) ..... 2006-160293
May 29, 2007 (JP) ..... 2007-142097

(51) Int. Cl.
*G03G 15/00* (2006.01)

(52) U.S. Cl. ..... 399/389; 271/258.01

(58) Field of Classification Search ..... 399/389, 399/391, 21, 22, 43
See application file for complete search history.

(56) References Cited

U.S. PATENT DOCUMENTS 4,548,394 A * 10/1985 Koyama et al. ..... 271/9.11
5,488,463 A * 1/1996 Nimura et al. ..... 399/381
5,962,861 A * 10/1999 Fowler ..... 250/559.27
7,502,571 B2 * 3/2009 Mizude et al. ..... 399/21
2002/0009302 A1 * 1/2002 Kodama et al. ..... 399/18
2006/0062610 A1 * 3/2006 Ito et al. ..... 399/328

FOREIGN PATENT DOCUMENTS

JP 62205947 A * 9/1987
JP 9-040217 2/1997
JP 2002-154682 5/2002

OTHER PUBLICATIONS

JP 9-040217 Machine Translation.*

* cited by examiner

*Primary Examiner* — Ren Yan
*Assistant Examiner* — Allister Primo
(74) *Attorney, Agent, or Firm* — Fitzpatrick, Cella, Harper & Scinto

(57) ABSTRACT

Preventing a paper jam as much as possible when actual paper size differs from designated paper size with increasing throughput by starting conveyance of a second sheet before detecting the length of a first sheet. Unless a register sensor has detected the rear edge (step S303), start of feeding the next sheet is checked (step S304). If started, a prescribed value 1 is applied (step S305). If not started, a prescribed value 2 is applied (step S306). Unless the rear edge is detected before a timer measures "estimated time+prescribed value" (step S307), a paper jam decision is made (step S308). If the rear edge is detected before the timer measures the "estimated time+prescribed value" (step S303), the processing is completed without making a paper jam decision. Making the prescribed value 1 less than the prescribed value 2 enables reducing the paper jam caused by incorrect setting.

10 Claims, 8 Drawing Sheets

IMAGE FORMING APPARATUS AND CONVEYANCE MALFUNCTION DECISION METHOD

BACKGROUND OF THE INVENTION

1. Field of the Invention

The present invention relates to an image forming apparatus and a conveyance malfunction decision method in an image forming apparatus, and more particularly to an image forming apparatus for forming images through electrophotographic process such as a copying machine and printer, and to a conveyance malfunction decision method in the image forming apparatus.

2. Description of Related Art

Conventionally, an image forming apparatus has a sensor mounted on a conveyance path, make it detect the paper length, and if the size of paper actually placed in the paper feed section differs from that of paper designated to be printed, it decides that a paper jam occurs and reports it. For example, if a user fails to adjust a sliding piece in a paper cassette that automatically detects the paper size, it might occur that the automatically detected paper size differs from the real paper size. In this case, a decision is made that a conveyance malfunction (also referred to as a paper jam) occurs if the length detected by the sensor on the conveyance path differs from the size automatically detected by the cassette (see Japanese Patent Laid-Open No. 09-40217/1998, for example).

Besides, an image forming apparatus is proposed which circumvents a paper jam by employing a control method that detects the length of only the first sheet of printing while feeding and conveying it, and then feeds the second and subsequent sheets according to the paper length detected (see Japanese Patent Laid-Open No. 2002-154682, for example).

Recently, however, to further increase the printing efficiency of the image forming apparatus, improvement has been required in the printing speed (the number of sheets printed in a unit period of time: referred to as "throughput" from now on). In the foregoing control method that detects the length of only the first sheet while feeding and conveying it, and then feeds the second and subsequent sheets, the second sheet cannot be fed until completing the detection of the length of the first sheet. Thus, the method cannot achieve the improvement in the throughput. Accordingly, to improve the throughput, it is necessary to start the feed and conveyance of the second sheet before completing the detection of the length of the first sheet while feeding and conveying it. In this case, a problem can arise of causing a paper jam because of the difference in the size between the paper actually placed and the paper designated to be printed.

The present invention is implemented to solve the foregoing problem. It is therefore an object of the present invention to reduce the conveyance malfunction as much as possible when a real sheet differs in size from the sheet set to be printed, while increasing throughput by starting the feed and conveyance of the second sheet before the detection of the paper length of the first sheet has been completed.

SUMMARY OF THE INVENTION

To accomplish the problem, the image forming apparatus in accordance with the present invention comprises: a paper feed section for feeding a sheet; an image forming section for forming an image on the sheet; and a control section for controlling operation of the paper feed section in a manner that the paper feed section feeds a plurality of sheets at intervals based on a preset paper size when forming an image successively on the plurality of sheets, wherein while carrying out detection of a paper size of the sheet fed by the paper feed section, the control section controls operation to decide whether a paper feed of a next sheet has been started or not, and sets timing for detecting a conveyance malfunction of the sheet in response to a decision result.

In addition, the image forming method in accordance with the present invention is a conveyance malfunction decision method of an image forming apparatus including a paper feed section for feeding a sheet, and an image forming section for forming an image on the sheet, the conveyance malfunction decision method comprising: a step of feeding a plurality of sheets from the paper feed section at intervals based on a preset paper size to successively form an image on the plurality of sheets; a step of detecting a conveyance malfunction of the sheet in accordance with the preset paper size; and a step of deciding whether a paper feed of a next sheet has been started or not while carrying out detection of the paper size of the sheet fed by the paper feed section, and of setting timing for detecting a conveyance malfunction in response to a decision result.

According to the present invention, a paper jam can be reduced as much as possible when actual paper size differs from the designated paper size with increasing the throughput by starting paper conveyance of a second sheet before detecting the length of a first sheet.

Further features of the present invention will become apparent from the following description of exemplary embodiments (with reference to the attached drawings).

DESCRIPTION OF THE EMBODIMENTS

The image forming apparatus and its method in accordance with the present invention will now be described with reference to the accompanying drawings.

Embodiment 1

Figure 1:
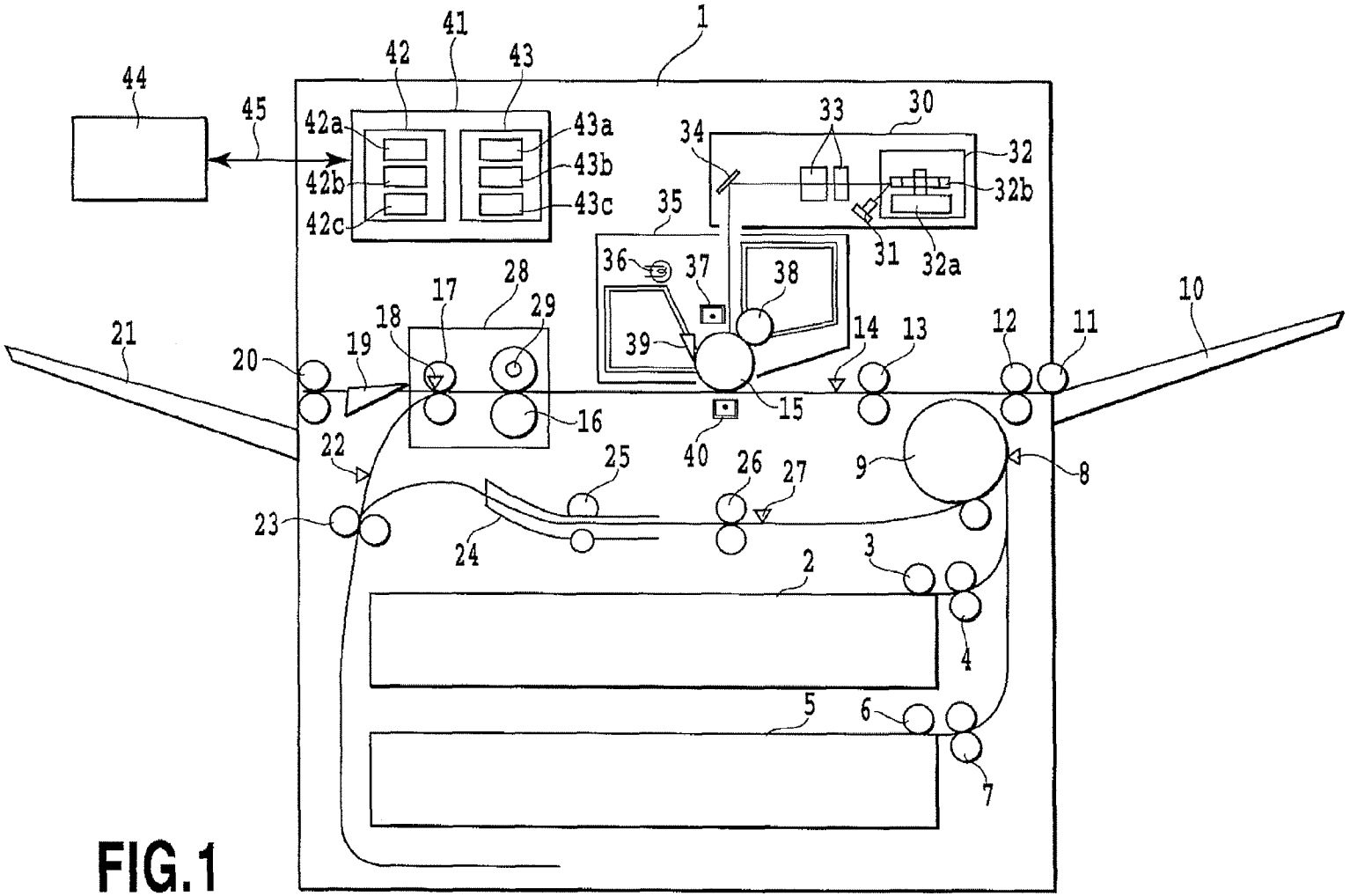
FIG. 1 is a cross-sectional view of an image forming apparatus of an embodiment in accordance with the present invention.

FIG. 1 is a cross-sectional view of an image forming apparatus of an embodiment in accordance with the present invention. Here, a laser printer is taken as an example. A printer main body 1 has an upper cassette 2 and a lower cassette 5 for holding recording media or recording paper serving as a recording material. Each recording medium is put out of the upper cassette 2 by an upper pickup feeder roller 3, and is conveyed by upper paper conveyance rollers 4. Likewise, each recording medium is put out of the lower cassette 5 by a lower pickup feeder roller 6, and is conveyed by lower paper conveyance rollers 7. The recording medium conveyed from the upper cassette 2 or lower cassette 5 is detected by a downstream paper sensor 8, and is further conveyed by a refeeding roller 9. In addition, a recording medium is put out of a multi-tray 10 holding recording media by a multi-pickup feeder roller 11, and is conveyed by multi-paper conveyance rollers 12.

The recording medium sent out and conveyed from the upper cassette 2, lower cassette 5 or multi-tray 10 is further conveyed by a roller pair 13 (also referred to as "register roller pair"), is detected by a downstream sensor 14 (called "register sensor" from now on), and is synchronized with the image forming timing (VSYNC signal). A removable process cartridge 35 is mounted downstream which forms a toner image on a photoconductive drum (electro-photosensitive body) 15 using a laser beam from a laser scanner unit 30. The toner image on the photoconductive drum 15 is transferred to a recording medium by a transfer unit 40. In addition, a fixing unit 28 is provided downstream for fixing the toner image formed on the recording medium with applying heat and pressure. Downstream of the fixing unit 28, are provided a fixing output sensor 18 for detecting conveyance conditions and fixing output rollers 17 for conveying the recording medium to an output section. The recording medium is output to an output loading tray 21 by output rollers 20.

To carry out double-sided printing, a double-side flapper 19 guides the recording medium to a reversing mechanism. The recording medium guided to the reversing mechanism is detected by a reversing sensor 22, and is pulled in by reversing rollers 23. After completing the pulling, the recording medium is reversed by reversing the direction of rotation of the reversing rollers 23, and is led to a double-side conveyance section. The recording medium led to the double-side conveyance section is conveyed by a half roller 25, and is stopped at a place where the recording medium makes contact with the halved portion of the half roller 25. Then, at the location where the recording medium becomes movable, its oblique going is corrected by a registration control plate 24. After that, the half roller 25 restarts the conveyance, followed by downstream double-side rollers 26 and a double-side sensor 27 for confirming the conveyance position of the recording medium. Then, after being conveyed by the refeeding roller 9, the recording medium undergoes the image forming of its second side.

The laser scanner unit 30 includes a laser unit 31 for emitting the laser beam modulated in response to an image signal delivered from a video controller 42, and a scanner motor unit 32 for causing the laser beam from the laser unit 31 to scan the photoconductive drum 15. In addition, the laser scanner unit 30 includes an imaging lens set 33 and a mirror 34. The scanner motor unit 32 is composed of a scanner motor 32*a* and a polygon mirror 32*b*. The process cartridge 35 includes the photoconductive drum 15 necessary for the electrophotographic process, a pre-exposure unit 36, a charging unit 37, a developing unit 38, a transfer unit 40 and a cleaner 39. The fixing unit 28, a thermal roller type fixing unit, is composed of a heating and pressurizing rotating body 16 consisting of a heating roller and a pressurizing roller, and a heater 29, a halogen heater provided within the heating roller. The heating roller has its surface make contact with a temperature detecting element not shown so that the heater is turned on and off in response to the temperature detection result to regulated the roller surface temperature at constant. The photoconductive drum 15, pre-exposure unit 36, charging unit 37, developing unit 38, transfer unit 40 and fixing unit 28 are also referred to as an image forming section of the image forming apparatus.

A printer control unit 41 is a unit for controlling the printer main body 1, and is composed of the video controller 42 and an engine control section 43. The video controller 42 is composed of a microcomputer 42*a*, a timer 42*b*, a nonvolatile memory 42*c* and the like. The engine control section 43 is composed of a microcomputer 43*a*, a timer 43*b* and a nonvolatile memory 43*c*. Furthermore, the printer control unit 41 is communicably connected to an external unit 44 (such as a host computer) via an interface 45. In addition, although not shown here, a cooling fan 50 is provided. Besides, although not shown here, the printer main body 1 has a display control panel 51 for notifying a user of information, and for the user to carry out selection and settings.

Figure 2:
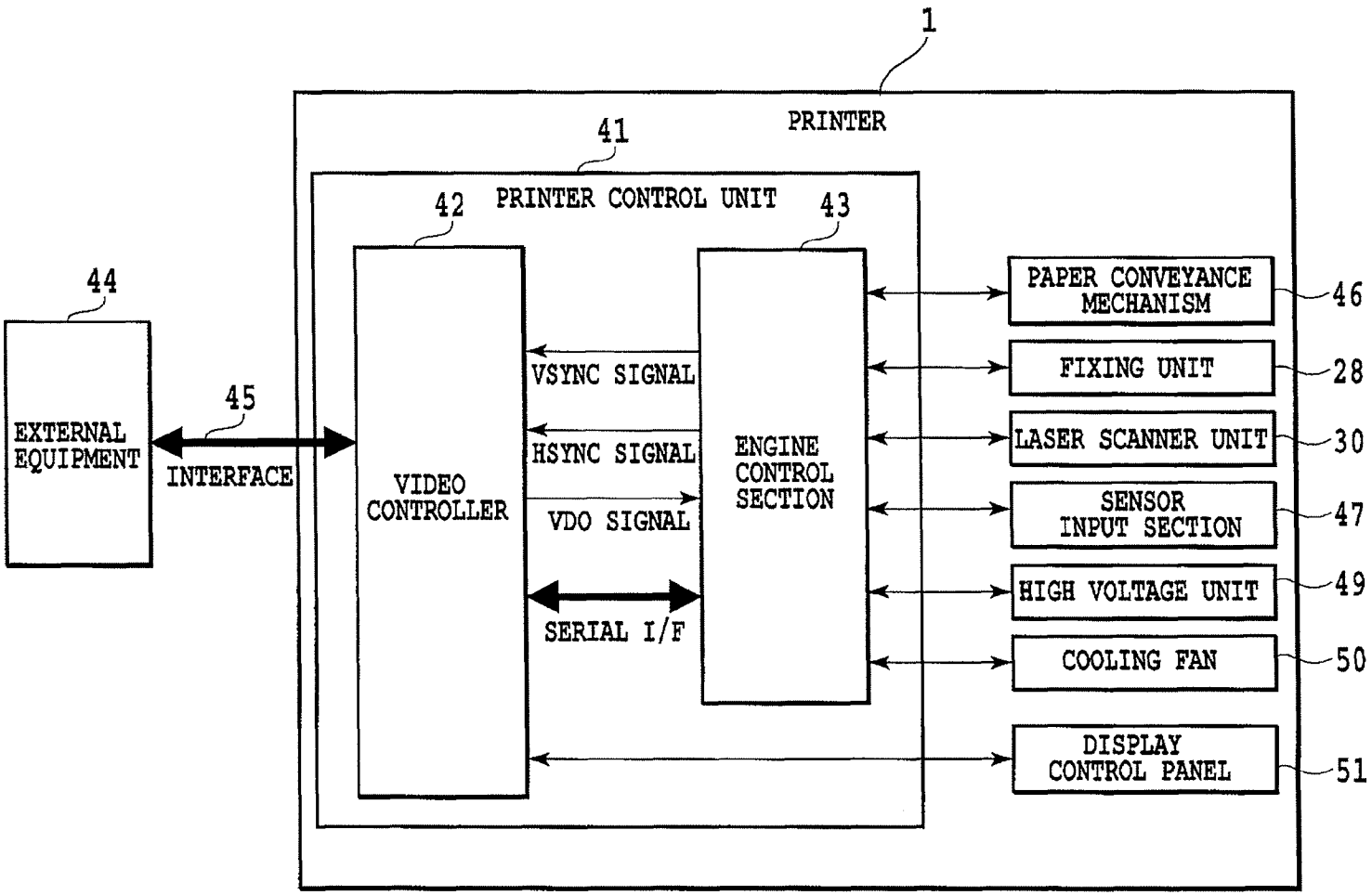
FIG. 2 is a block diagram showing a functional configuration of the embodiment in accordance with the present invention.

FIG. 2 is a block diagram showing a functional configuration of the image forming apparatus of a first embodiment in accordance with the present invention. The printer main body 1 includes the printer control unit 41 composed of the video controller 42 and engine control section 43. The video controller 42 develops image data transmitted from external equipment 44 such as a host computer via the interface 45 into bit data necessary for printing of the printer. The video controller 42 assigns printing conditions (such as a paper feed slit and paper output slit) to the engine control section 43 via a serial I/F for each image to be printed.

The video controller 42 gives a printing instruction to the engine control section 43 after completing the development into the bit data. The engine control section 43 controls the printing in response to the printing conditions received from the video controller 42. The engine control section 43 rotates the photoconductive drum 15, and controls a paper conveyance mechanism 46 such as the feeder rollers, conveyance rollers and lifters, thereby feeding paper from the paper feed slit designated by the printing conditions. A high voltage unit 49 applies a high voltage to the charging unit 37 to charge the photoconductive drum surface uniformly, and applies a high voltage to the developing unit 38. Then, to synchronize the recording medium with the image forming, the engine control section 43 supplies the video controller 42 with the vertical sync signal (VSYNC signal) for each recording medium. In addition, out putting a horizontal sync signal (HSYNC signal) for each line, the engine control section 43 carries out image forming with controlling the laser scanner unit 30 in response to a video signal (VDO signal) fed from the video controller 42. Then, the engine control section 43 controls in such a manner that the developing unit 38 develops the formed image by applying the developing high voltage from the high voltage unit 49; the transfer unit 40 transfers the image to the paper by applying a transfer high voltage; the fixing unit 28 fixes the image; and the paper conveyance mechanism 46 ejects the paper through the paper output slit designated by the printing conditions.

The video controller 42 has functions of displaying the printer conditions on a display control panel 51, and of recognizing setting contents of the user through the display control panel 51. In addition, the engine control section 43 reads the various sensors via a sensor input section 47, and detects the presence or absence of the paper with the sensors on the conveyance path. The engine control section 43 drives the cooling fan 50 to cool the image forming apparatus.

Next, the multi-tray 10, upper cassette 2 and lower cassette 5 will be described which serve as a plurality of paper feed sections of the image forming apparatus.

The multi-tray 10 does not have a sensor for detecting the paper size. Thus, the user designates the paper size through the display control panel 51, or designates and sends the paper size via the external equipment 44 such as a computer. The video controller 42 notifies the engine control section 43 of the paper size designated, and the engine control section 43 sets the notified paper size as the paper size of the multi-tray 10. Thus, the engine control section 43 carries out the paper conveyance control in the paper conveyance mechanism 46 such as successive paper feed at regular intervals determined by the designated paper size.

The upper cassette 2 and lower cassette 5 each have a sensor not shown for detecting the paper size. The sensors automatically detect the paper size placed by the user (Patent Document 1, for example, discloses the system of detecting the paper size by adjusting a sliding piece and by reading the switch information about that piece). Alternatively, there are some structures that employ a rotational piece instead of the sliding piece. There are other arrangements that automatically detect the paper size by reading the positions of sliding plates for adjusting the position of the sheets held in the longitudinal and lateral directions.

The engine control section 43 sets the automatically detected paper sizes according to the paper size sensor information about the upper cassette 2 and lower cassette 5, as the paper sizes of these cassettes. Then it carries out the paper conveyance control in the paper conveyance mechanism 46 in accordance with the set paper sizes. Here, the term "paper size" used in the paper conveyance control refers to the paper size (paper length) in the paper conveyance direction.

In the multi-tray 10, the designated paper size may differ from the actually placed paper size because of the user's erroneous designation of the paper size. In addition, the automatically detected paper size may differ from the paper size actually held in the upper cassette 2 or lower cassette 5 because the user operates the sliding piece of the cassette or sliding plates erroneously. The engine control section 43 carries out the paper conveyance control according to the paper length of the designated paper size, and detects the length of the paper conveyed with the register sensor 14. More specifically, the engine control section 43 measures the duration from the time at which the front edge of the paper which is fed and conveyed passes the register sensor 14 to the time at which the rear edge of the paper has left the register sensor 14. Thus, the engine control section 43 measures the real length of the paper from the transit time of the paper obtained here and the conveyance speed at that time. The detection (measurement) of the paper length is carried out by the engine control section 43.

Next, the processing of the present embodiment will be described. First, if the paper length detected is longer than the paper length of the designated paper size by a prescribed value, the engine control section 43 makes a paper jam decision as in the example of Patent Document 1. To increase the throughput, such a method as described in Patent Document 2 is not employed which starts feeding the second sheet in response to the measured paper length after completing the measurement of the paper length of the first sheet. The present embodiment starts feeding the second sheet in response to the paper length of the designated paper size before completing the measurement of the paper length of the first sheet, that is, during the measurement of the paper length of the first sheet. A greater number of users designate the paper size correctly and operate the sliding piece of cassette or sliding plates correctly. Accordingly, it is much advantageous to the user to give priority to increase the throughput. Some users, however, may erroneously designate or operate the sliding piece of cassette or sliding plates. Thus, the present embodiment carries out the following paper jam decision control to increase the throughput with preventing halting the apparatus as much as possible because of a decision of a conveyance malfunction (a paper jam).

Figure 3:
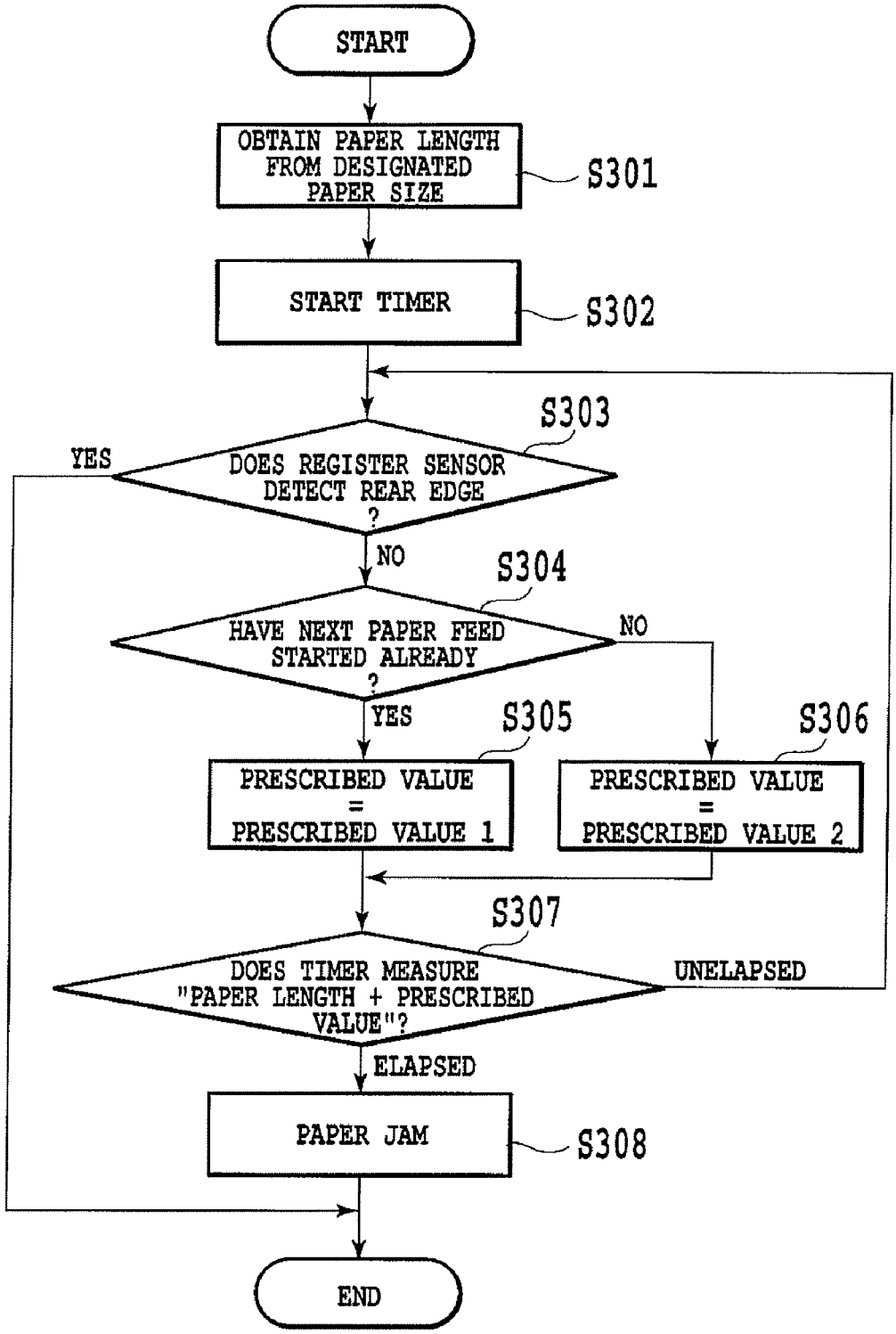
FIG. 3 is a flowchart illustrating paper jam decision control of an embodiment in accordance with the present invention.

The conveyance malfunction decision method of the present embodiment will be described below. FIG. 3 is a flowchart illustrating the paper jam decision control of the image forming apparatus of the first embodiment in accordance with the present invention. First, an estimated time is calculated which is taken by the paper to pass through the register sensor 14 when the designated paper size is correct by using the designated paper size and the conveyance speed at that point (not shown). In the present embodiment, the flowchart starts from the point at which the register sensor 14 detects the front edge of the paper fed. First, the paper length is obtained from the designated paper size that is preset (the paper size designated by the user for the multi-tray 10, and the automatically detected paper size for the upper cassette 2 or lower cassette 5) (step S301). Subsequently, the estimated time is calculated, followed by starting the timer (step S302). A paper jam decision is made with keeping watch on the timer until the register sensor 14 detects the rear edge.

Subsequently, if the register sensor 14 has not yet detected the rear edge in the estimated time (step S303), start of feeding the next paper is checked (step S304). If it is started, a prescribed value 1 is applied (step S305), otherwise a prescribed value 2 is applied (step S306). Then, unless the rear edge is detected before the timer measures "estimated time+prescribed value (prescribed value 1 or prescribed value 2)" (step S307), a decision is made that a paper jam occurs (step S308). When the rear edge is detected before the timer measures the "estimated time+prescribed value" (step S303), a decision is made that the paper jam does not occur. If the real paper is longer than the designated paper size because of the user error, and if the next paper has not yet been fed, it is possible to automatically output the paper as a misprint without making a paper jam decision by delaying the paper jam detection timing. Thus, by making the prescribed value 2 greater than the prescribed value 1, the paper jam due to erroneous setting can be reduced.

The prescribed value is a time for modifying the estimated time for making a paper jam decision: One of the prescribed value 1 and prescribed value 2 is selected in accordance with conditions as described above, and is added to the estimated time. As for the calculation of the time, an arithmetic circuit (not shown) serving as a calculating section provided in the engine control section 43 carries it out.

More specifically, when the preset paper size is $\alpha$ size, the estimated time $\alpha T$ based on the $\alpha$ size is calculated. Then, when the register sensor 14 counts the time $\alpha T$ from the detection of the front edge of the paper, a decision is made as to whether the register sensor 14 detects the rear edge of the paper. After that, the prescribed value to be added is selected as described above depending on whether the feed of the next paper has already been started or not. In this case, if feed of the next paper is started, $\alpha T$+prescribed value 1 is set, otherwise $\alpha T$+prescribed value 2 is set.

Thus, if the actually fed paper size is greater than the preset paper size, the estimated time for making a paper jam decision is delayed without making a paper jam decision. In this case, the delay time is switched depending on the feeding conditions of the next paper.

It is preferable that the prescribed value 1 be set within a limit of the timing that will prevent the overlap between the rear edge of the paper and the front edge of the next paper when the next paper is fed in accordance with the paper length of the designated paper size. On the other hand, it is preferable that the prescribed value 2 be set at a value which is greater than the prescribed value 1 such as about twice the paper length of the designated paper size, and which will be able to prevent an accordion-like paper jam due to erroneous setting of the designated paper size, thereby avoiding damage to the printer 1.

As default settings for the paper feed, it has been set that the next paper is fed while detecting the paper length in response to the preset paper size. Intervals of the paper feed are determined at such timing that will prevent the overlap between the rear edge of the previous paper and the front edge of the next paper, and are set as short as possible.

The case of the foregoing step S306 of FIG. 3, that is, the case where the next paper feed is not performed during the paper length detection is the case where the paper feed is retried because of the failure of the paper feed, or the paper has run out.

As described above, the present embodiment can optimize the paper jam detection timing depending on whether the next paper feed has been completed or not with increasing the throughput by starting to feed the following second sheet in accordance with the designated paper size before completing the measurement of the paper length of the first sheet. Thus, the present embodiment can provide the image forming apparatus and its method capable of continuing the processing without making a conveyance malfunction decision as much as possible in spite of the erroneous setting of the user.

Second Embodiment

Since the image forming apparatus of the present embodiment has the same configuration and functional configuration as the first embodiment described above, their description will be omitted here. The following description will be made with reference to FIGS. 1 and 2. Although the image forming apparatus of the first embodiment changes and applies the "prescribed value" depending on whether the feed of the next paper has been started or not, the present embodiment changes the prescribed value to be applied for each paper feeder.

More specifically, when the throughput is identical, the feed timing of the next paper becomes earlier as the paper is fed from the paper feed slit more distant from the register sensor 14. Consider the case where the user setting is incorrect and the real paper length is longer than the preset paper length. In this case, if the paper is fed from the paper feed slit closer to the image forming apparatus and the next paper has not yet been fed, the current paper can be automatically output by delaying the paper jam decision timing and by making a misprint decision instead of a paper jam. Thus, the paper jam based on the incorrect setting can be reduced by setting the prescribed value 1 of the lower cassette (the paper feed slit most distant from the image forming apparatus)<the prescribed value 2 of the upper cassette (the paper feed slit more distant from the image forming apparatus)<the prescribed value 3 of the multi-tray (the paper feed slit closest to the image forming apparatus). As for the prescribed values 1-3 for the respective paper feed slits, it is preferable that they are set within a limit of the timing that will prevent the overlap between the rear edge of the paper and the front edge of the next paper when the next paper is fed in accordance with the paper length of the designated paper size.

Figure 4:
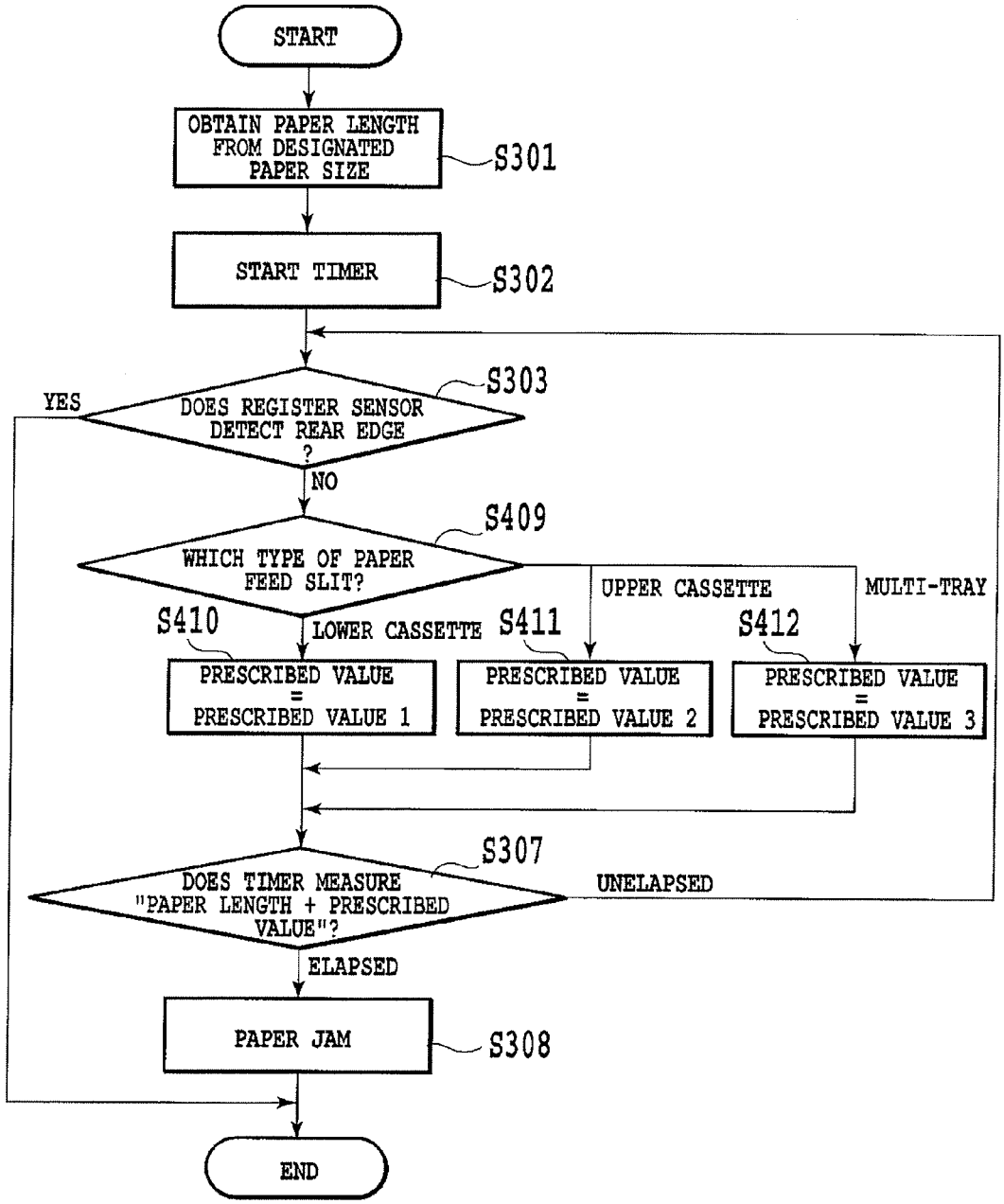
FIG. 4 is a flowchart illustrating paper jam decision control of an embodiment in accordance with the present invention.

The conveyance malfunction decision method of the present embodiment will be described below. FIG. 4 is a flowchart illustrating the paper jam decision control in the image forming apparatus of the second embodiment in accordance with the present invention. Compared with FIG. 3 used for describing the first embodiment, steps S301-S303 and steps S307-S308 are the same, and newly added steps S409-S412 differ.

As in the foregoing embodiment 1, the flowchart starts from the point at which the register sensor 14 detects the front edge of the paper fed. First, the paper length is obtained from the designated paper size (the paper size designated by the user for the multi-tray 10, and the automatically detected paper size for the upper cassette 2 or lower cassette 5) (step S301), followed by starting the timer (step S302). Here, the estimated time is calculated from the paper length as in the first embodiment.

A paper jam decision is made with keeping watch on the timer until the register sensor 14 detects the rear edge. If the register sensor 14 has not yet detected the rear edge when the estimated time has elapsed (step S303), the type of the paper feed slit is decided (step S409). If it is the lower cassette 5, the prescribed value 1 is applied (step S410); if it is the upper cassette 2, the prescribed value 2 is applied (step S411); and if it is the multi-tray 10, the prescribed value 3 is applied (step S412). Then, unless the rear edge is detected before the timer measures the "estimated time+prescribed value" (step S307), a decision is made that a paper jam occurs (step S308). When the rear edge is detected before the timer measures the "estimated time+prescribed value" (step S303), a decision is made that the paper jam does not occur, and the processing is completed.

The prescribed value is a time for modifying the estimated time for making a paper jam decision: One of the prescribed values is selected in accordance with the conditions as described above, and is added to the estimated time. As for the calculation of the time, the arithmetic circuit (not shown) serving as a calculating section provided in the engine control section 43 carries it out.

Thus, if the actually fed paper size is greater than the preset paper size, the present embodiment delays the estimated time for making a paper jam decision without making a paper jam decision. In this case, the delay time is switched depending on which paper feeder feeds the paper.

As described above, the present embodiment can optimize the paper jam decision timing for respective paper feed slits with increasing the throughput by starting to feed the following second sheet in accordance with the length of the designated paper size before completing the measurement of the paper length of the first sheet. Thus, the present embodiment can provide the image forming apparatus capable of avoiding a conveyance malfunction decision as much as possible in spite of the erroneous setting of the paper size by the user.

Third Embodiment

Since the image forming apparatus of the present embodiment has the same configuration and functional configuration as the first embodiment described above, their description will be omitted here. The following description will be made with reference to FIGS. 1 and 2. Although the image forming apparatus of the first embodiment changes and applies the "prescribed value" depending on whether the feed of the next paper has been started or not, the present embodiment changes the prescribed value to be applied for various image forming conditions.

More specifically, the throughput generally varies according to printing conditions such as a printing mode (normal mode, thick-paper mode, thin-paper mode, OHT mode, envelope mode, or postcard mode) and paper size. For example, when the paper width (the paper size in the direction orthogonal to the conveyance direction) is narrow, the throughput must be reduced because of an edge temperature rise of the fixing unit. To change the throughput, paper feed intervals are made variable. In other words, the paper feed intervals take various values from small to large values. Even if the actual paper is longer than the paper length of the designated paper size because of the incorrect setting of the user, if the next paper has not yet been fed because of the long paper feed intervals, it is possible to automatically output the paper as a misprint without making a paper jam decision by delaying the paper jam detection timing. Accordingly, the paper jam due to incorrect setting can be reduced by setting the prescribed value 1 for short paper feed intervals<the prescribed value 2 for middle paper feed intervals<the prescribed value 3 for long paper feed intervals. As for the prescribed values 1-3 corresponding to the paper feed intervals, it is preferable that they are set within a limit of the timing that will prevent the overlap between the rear edge of the paper and the front edge of the next paper when the next paper is fed in accordance with the paper length of the designated paper size. Although the paper feed intervals are set at three levels (small, middle and large), they can be divided into a greater number of levels.

Figure 5:
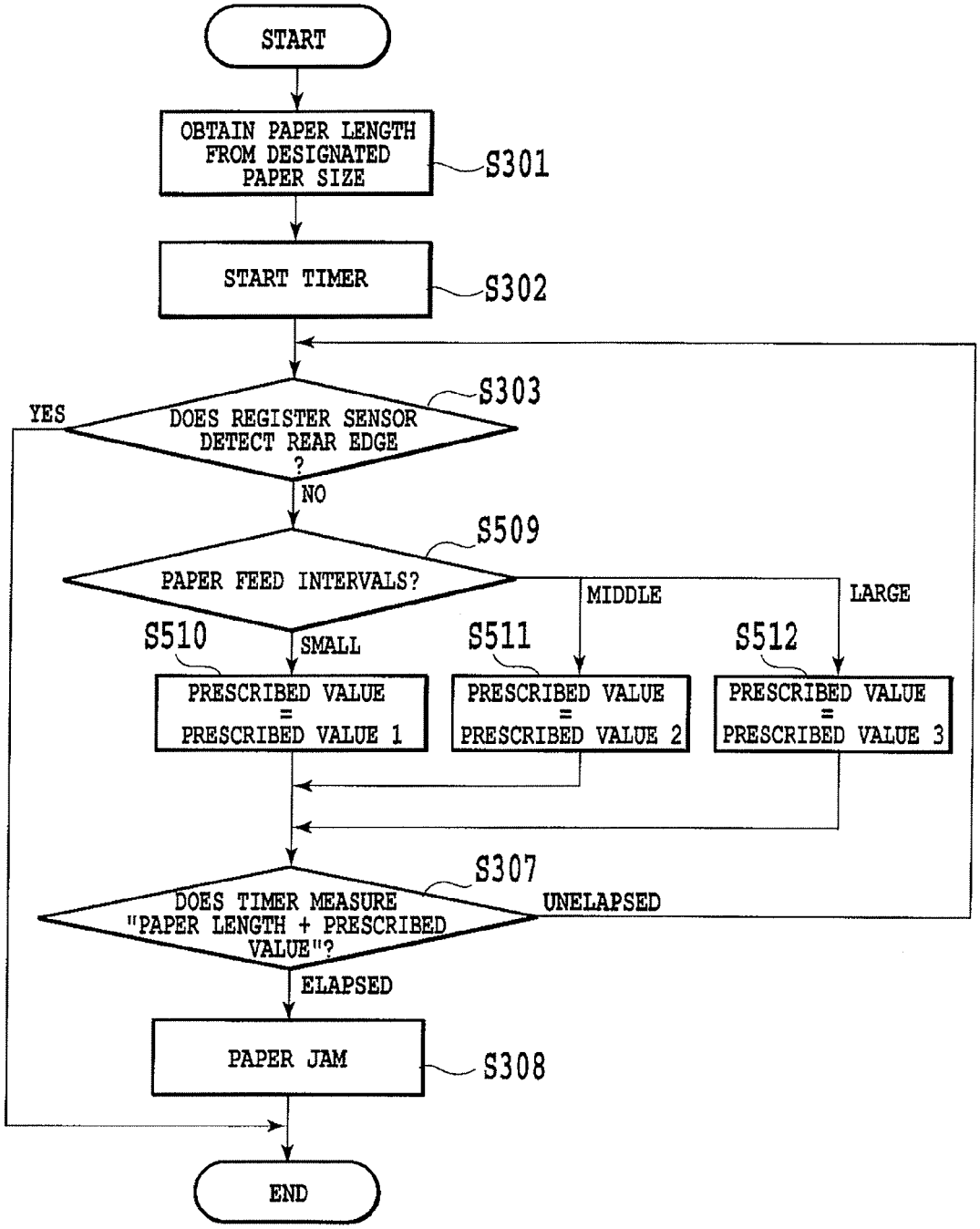
FIG. 5 is a flowchart illustrating paper jam decision control of an embodiment in accordance with the present invention.

The conveyance malfunction decision method of the present embodiment will be described below. FIG. 5 is a flowchart illustrating the paper jam decision control in the image forming apparatus of the third embodiment in accordance with the present invention. Compared with FIG. 3 used for describing the first embodiment, steps S301-S303 and steps S307-S308 are the same, and steps S509-S512 are newly added. The flowchart starts from the point at which the register sensor 14 detects the front edge of the paper fed. First, the paper length is obtained from the designated paper size (the paper size designated by the user for the multi-tray 10, and the automatically detected paper size for the upper cassette 2 or lower cassette 5) (step S301), followed by starting the timer (step S302). A paper jam decision is made with keeping watch on the timer until the register sensor 14 detects the rear edge. If the register sensor 14 has not yet detected the rear edge when the estimated time has elapsed (step S303), a decision is made as to the paper feed interval between the paper and the next paper (step S509). If the paper feed interval is small, the prescribed value 1 is adopted (step S510); if it is middle, the prescribed value 2 is adopted (step S511); and if it is large, the prescribed value 3 is adopted (step S512). Then, unless the rear edge is detected before the timer measures the "estimated time+prescribed value" (step S307), a decision is made that a paper jam occurs (step S308). When the rear edge is detected before the timer measures the "estimated time+prescribed value" (step S303), a decision is made that the paper jam does not occur, and the processing is completed.

The prescribed value is a time for modifying the estimated time for making a paper jam decision: One of the prescribed values is selected in accordance with the conditions as described above, and is added to the estimated time. As for the calculation of the time, the arithmetic circuit (not shown) serving as a calculating section provided in the engine control section 43 carries it out.

Thus, if the actually fed paper size is greater than the preset paper size, the present embodiment delays the estimated time for making a paper jam decision without making a paper jam decision. In this case, the delay time is switched depending on the image forming conditions.

As described above, the present embodiment optimizes the paper jam decision timing for respective paper feed intervals with increasing the throughput by starting to feed the following second sheet in accordance with the length of the designated paper size before completing the measurement of the paper length of the first sheet. Thus, the present embodiment can avoid a conveyance malfunction decision as much as possible in spite of the erroneous setting of the paper size by the user.

Fourth Embodiment

Since the image forming apparatus of the present embodiment has the same configuration and functional configuration as that of the first embodiment, their description will be omitted here. The following description will be made with reference to FIGS. 1 and 2. Although the image forming apparatus of the first embodiment changes the "prescribed value" depending on whether the feed of the succeeding paper has been started or not before applying it, the present embodiment changes the value to be applied at every paper feed interval.

More specifically, the throughput generally varies depending on the printing conditions such as a printing mode (a normal mode, thick-paper mode, thin-paper mode, OHT mode, envelope mode or postcard mode) and paper size. For example, when the paper width (the paper size in the direction orthogonal to the conveyance direction) is narrow, the throughput must be reduced because of an edge temperature rise of the fixing unit. To change the throughput, the paper feed intervals are made variable. In other words, the paper feed intervals take various values from small to large values. Even if the actual paper is longer than the paper length of the designated paper size because of the incorrect setting of the user, if the next paper has not yet been fed because of the long paper feed intervals, it is possible to automatically output the paper as a misprint without making a paper jam decision by delaying the paper jam detection timing.

Accordingly, it is preferable to calculate from the paper feed intervals decided from the printing conditions the timing that will prevent the overlap between the rear edge of the paper and the front edge of the next paper when the next paper is fed in accordance with the paper length of the designated paper size and the distance to the paper feed slit, and to set the timing as the prescribed value of the paper jam detection timing. For example, it is possible to employ the following calculation: the prescribed value=(Lint/V)+((Linput−Lpaper)/V), where Lpaper is the paper length, Linput is the length from the register sensor to the paper feed slit, Lint is the paper feed interval, and V is the conveyance speed.

Since it gives the value for calculating about the paper conveyance from the start of the paper feed, it is more preferable to consider a time taken for the paper to actually start to move from the start of the paper feed such as a time taken from the descent of the pickup feeder roller to the start of conveying the paper and a time from the drive of the solenoid and clutch to the start of conveying the paper. As for the maximum value of the prescribed value, it can be about twice the paper length of the designated paper size. Alternatively, it is preferably set at such a value that will prevent the accordion-like paper jam even if the erroneous paper size is set, thereby circumventing a damage to the printer 1.

Figure 6:
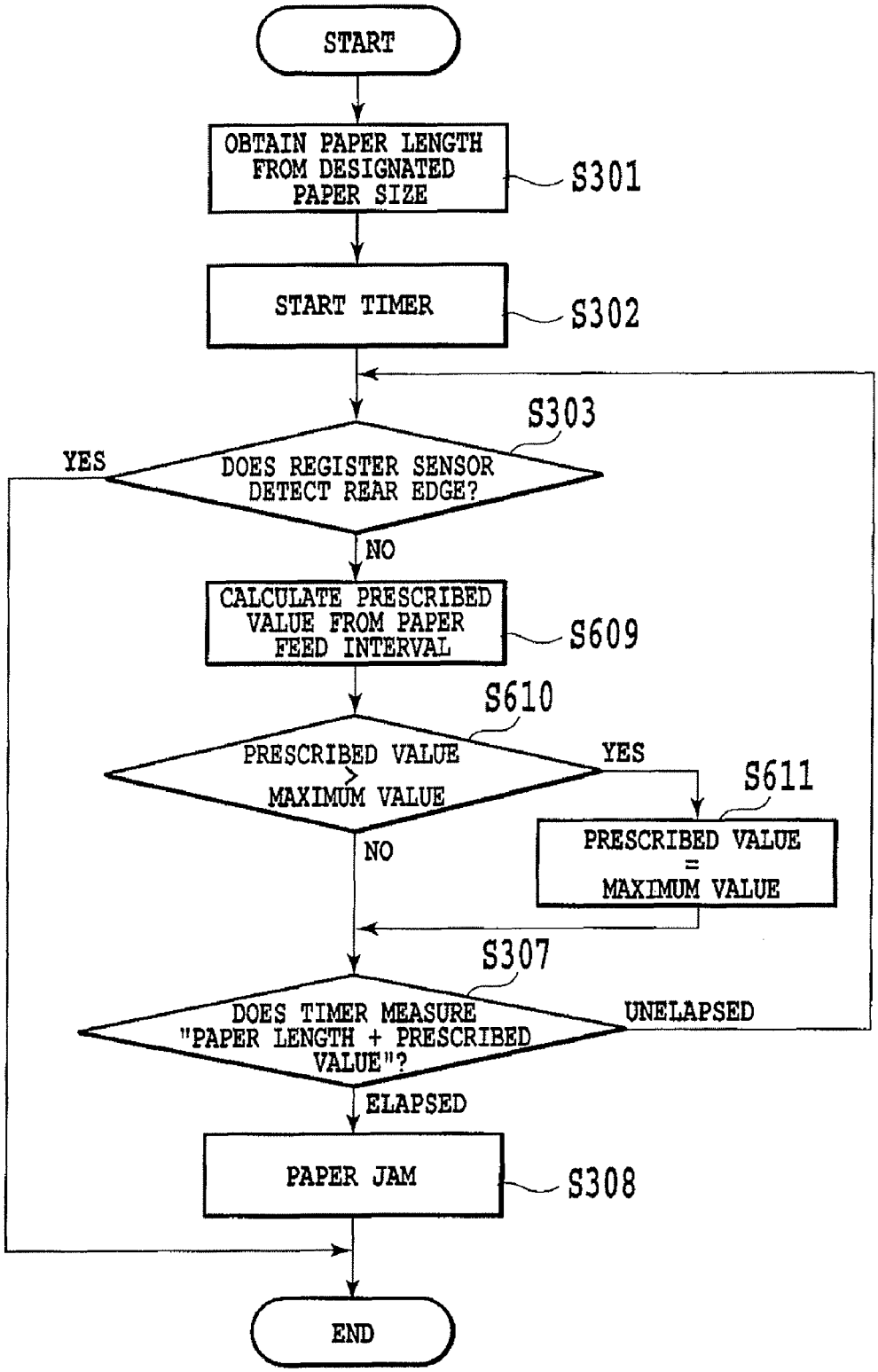
FIG. 6 is a flowchart illustrating paper jam decision control of an embodiment in accordance with the present invention.

The conveyance malfunction decision method of the present embodiment will be described below. FIG. 6 is a flowchart illustrating the paper jam decision control in the image forming apparatus of the fourth embodiment in accordance with the present invention. Compared with FIG. 3 used for describing the first embodiment, steps S301-S303 and steps S307-S308 are the same, and steps S609-S611 are newly added. The flowchart starts from the point at which the register sensor 14 detects the front edge of the paper fed. First, the paper length is obtained from the designated paper size (the paper size designated by the user for the multi-tray 10, and the automatically detected paper size for the upper cassette 2 or lower cassette 5) (step S301), followed by starting the timer (step S302). A paper jam decision is made with keeping watch on the timer until the register sensor 14 detects the rear edge. If the register sensor 14 has not yet detected the rear edge when the estimated time has elapsed (step S303), the prescribed value is calculated from the paper feed interval between the current paper and the next paper (step S609). If the calculated prescribed value is greater than the maximum value (step S610), the maximum value is made the prescribed value (step S611). Then, unless the rear edge is detected before the timer measures the "estimated time+prescribed value" (step S307), a decision is made that a paper jam occurs (step S308). When the rear edge is detected before the timer measures the "estimated time+prescribed value" (step S303), a decision is made that the paper jam does not occur, and the processing is completed.

The prescribed value and the maximum value are addition times for modifying the estimated time for deciding the paper jam. As described above, they are selected in accordance with the conditions, and are added to the estimated time. The calculation of the times are executed by the arithmetic circuit (not shown) serving as the calculating section provided in the engine control section 43.

Thus, if the actually fed paper size is greater than the preset paper size, the present embodiment delays the estimated time for making a paper jam decision without making a paper jam decision. In this case, the delay time is switched depending on the paper feed intervals.

As described above, the present embodiment calculates the optimum paper jam decision timing from the paper feed intervals with increasing the throughput by starting to feed the following second sheet in accordance with the length of the designated paper size before completing the measurement of the paper length of the first sheet. Thus, the present embodiment can provide the image forming apparatus capable of avoiding a conveyance malfunction decision as much as possible in spite of the erroneous setting of the paper size by the user.

Fifth Embodiment

Figure 7:
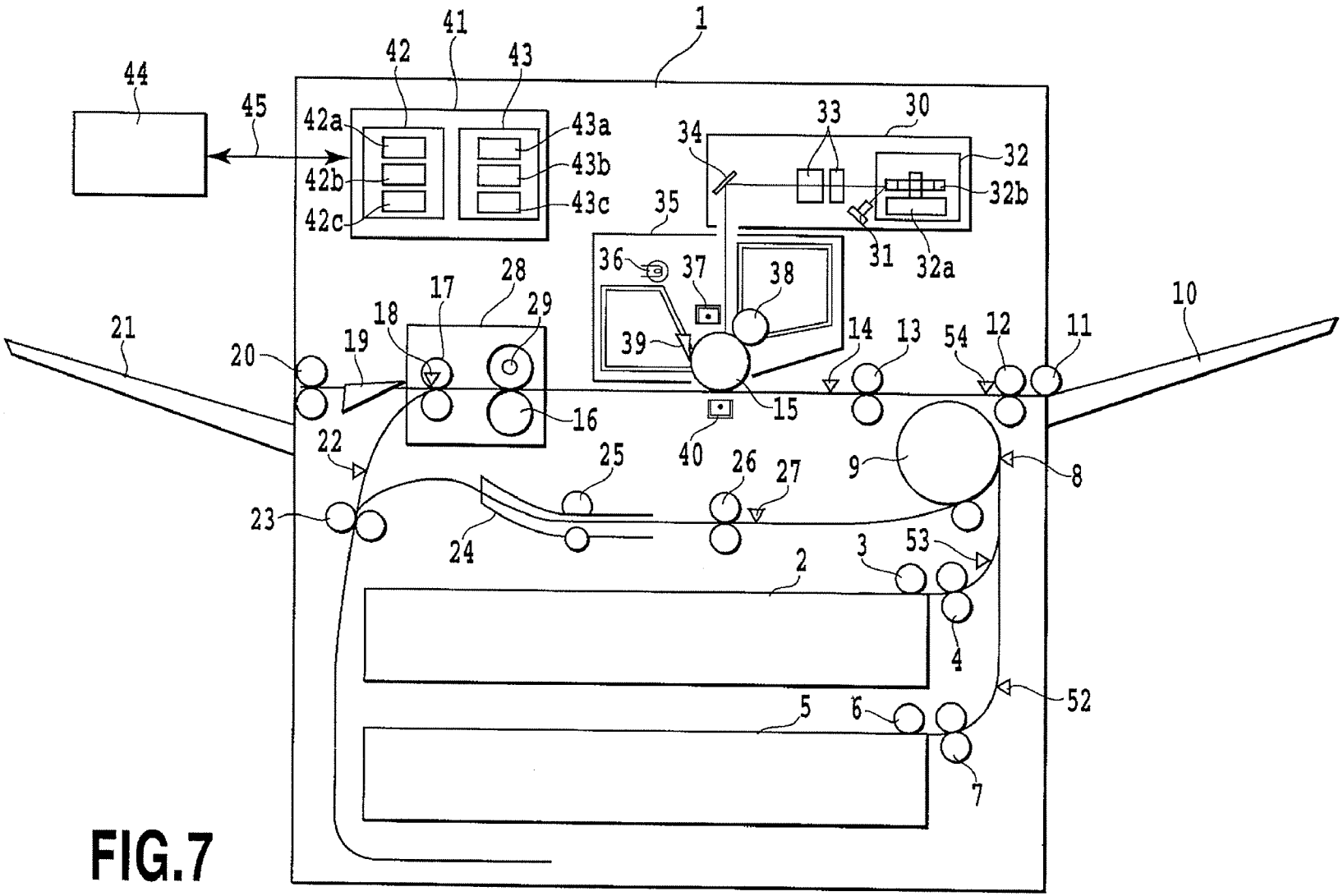
FIG. 7 is a cross-sectional view of an image forming apparatus of an embodiment in accordance with the present invention.

FIG. 7 is a cross-sectional view showing a configuration of the image forming apparatus of a fifth embodiment in accordance with the present invention. As compared with the configuration of FIG. 1 showing the first embodiment, a lower paper sensor 52, an upper paper sensor 53 and a multi-paper sensor 54 are added. The sensors 52-54 are each added to the downstream side of the conveyance path from the paper feed mechanisms of the upper cassette 2, lower cassette 5 and multi-tray 10. Thus, the image forming apparatus is devised that it can retry the paper feed by immediately detecting the failure of the paper feed with the sensors, thereby enabling an increase in the throughput.

Although the image forming apparatus of the first embodiment changes the "prescribed value" depending on whether the paper feed of the succeeding paper has been started or not before applying the value, the present embodiment utilizes the sensors provided on the paper feed section side (upstream). Thus, even if the rear edge of the paper fed does not pass by the register sensor 14, if it passes by the upstream sensor, the processing is carried out without a paper jam decision. In other words, it differs from the foregoing embodiments of utilizing the detection results of the plurality of sensors.

Figure 8:
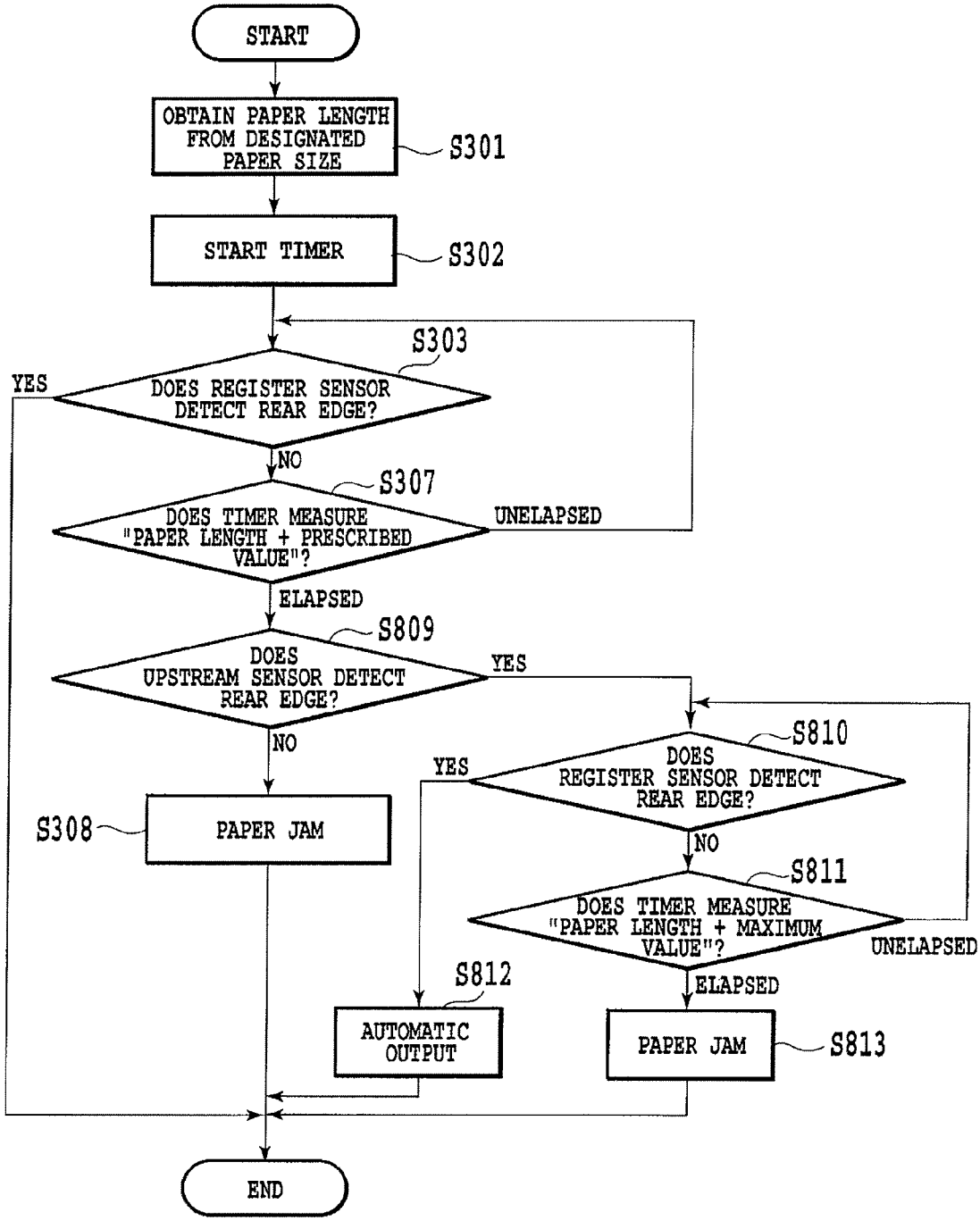
FIG. 8 is a flowchart illustrating paper jam decision control of the embodiment in accordance with the present invention.

The fifth embodiment in accordance with the present invention employs the functional configuration of the image forming apparatus as shown in FIG. 2. Since its contents are the same as those of the first embodiment, their description will be omitted here. FIG. 8 is a flowchart illustrating the paper jam decision control in the image forming apparatus of the fifth embodiment in accordance with the present invention. Compared with FIG. 3 used for describing the first embodiment, steps S301-S303 and steps S307-S308 are the same, and steps S809-S813 are newly added.

The conveyance malfunction decision method of the present embodiment will be described below. The flowchart starts from the point at which the register sensor 14 detects the front edge of the paper fed. First, the paper length is obtained from the designated paper size (the paper size designated by the user for the multi-tray 10, and the automatically detected paper size for the upper cassette 2 or lower cassette 5) (step S301), followed by starting the timer (step S302). A paper jam decision is made with keeping watch on the timer until the register sensor 14 detects the rear edge (step S303). When the rear edge is detected before the timer measures the "estimated time+prescribed value" (step S303), the processing is completed without making the paper jam decision. In contrast, unless the rear edge is detected before the timer measures the "estimated time+prescribed value" (step S307), a decision is made as to whether the upstream sensor (one of the lower paper sensor 52, upper paper sensor 53 and multi-paper sensor 54 is selected in accordance with the paper feeds lit) detects the rear edge (step S809) or not. Unless the upstream sensor detects the rear edge, a decision is made that double conveyance or the like occurs, and a paper jam decision is made (step S308). When the upstream sensor has detected the rear edge, a decision is made that the real paper is longer than the paper length of the designated paper size because of the incorrect setting of the user, and the detection of the rear edge by the register sensor 14 is waited for without the paper jam decision (step S811). When the rear edge is detected before the timer measures the "estimated time+maximum value" (step S810), a decision is made that the paper longer than the paper length of the designated paper size has passed through, and the paper is automatically output (step S812). Unless the rear edge is detected until the timer measures the "estimated time+maximum value", a decision is made that a real paper jam has occurred, and a paper jam decision is made (step S813). As for the maximum value of the prescribed value, it is preferably set at such a value that will prevent the accordion-like paper jam from actually occurring, thereby circumventing a damage to the printer 1.

The prescribed value and the maximum value are addition times for modifying the estimated time for deciding the paper jam. As described above, they are selected in accordance with the conditions, and are added to the estimated time. The calculation of the times are executed by the arithmetic circuit (not shown) serving as the calculating section provided in the engine control section 43.

As described above, the present embodiment optimizes the paper jam decision timing based on the information from the upstream sensor with increasing the throughput by starting to feed the following second sheet in accordance with the length of the designated paper size before completing the measurement of the paper length of the first sheet. Thus, the present embodiment can reduce the conveyance malfunction caused by the erroneous setting of the paper size by the user as much as possible.

Incidentally, if the processing is completed without making a paper jam decision in the foregoing first and second embodiments, a decision is made that the paper undergoes a misprint, and the conveyance is continued to output the paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-160293, filed Jun. 8, 2006 and 2007-142097, filed May 29, 2007, which are hereby incorporated by reference herein in their entirety.

What is claimed is:

1. An image forming apparatus comprising:

a sheet stacking section that holds sheets on which an image is to be formed;

a detecting unit that detects a conveyed sheet; and a control section that receives information related to the size of a sheet stacked on the sheet stacking section and sets a first detecting timing after time based on the information related to the size elapses subsequent to detecting a front edge of the conveyed sheet stacked on the sheet stacking section, wherein if the detecting unit has not detected a rear edge of a first sheet at the first detecting timing, said control section sets a second detecting timing by adding a first conveyance malfunction detecting time to detect a conveyance malfunction of the first sheet subsequent to the first detecting timing if a second sheet has started to be conveyed, and by adding a second conveyance malfunction detecting time longer than the first conveyance malfunction detecting time subsequent to the first detecting timing if the second sheet has not started to be conveyed.

2. The image forming apparatus as claimed in claim 1, further comprising an image forming section for forming an image on the conveyed sheet;

a first sheet stacking section that holds sheets; and a second sheet stacking section disposed closer to the image forming section than the first sheet stacking section, that holds sheets, wherein if the detecting unit has not detected the rear edge of the first sheet at the first detecting timing, said control section sets the second detecting timing by adding a conveyance malfunction detecting time for the first sheet stacking section to detect a conveyance malfunction of the first sheet to the first detecting timing if the second sheet is stacked on the first sheet stacking section and the second sheet has not started to be conveyed at the first detecting timing, and by adding a conveyance malfunction detecting time for the second sheet stacking section longer than the conveyance malfunction detecting time for the first sheet stacking section to the first detecting timing if the second sheet is stacked on the second sheet stacking section and the second sheet has not started to be conveyed at the first detecting timing.

3. The image forming apparatus as claimed in claim 1, further comprising an image forming section for forming an image on the conveyed sheet, wherein said image forming section includes a first image forming mode in which an image is formed by feeding a sheet at a first feed interval and a second image forming mode in which an image is formed by feeding a sheet at a second feed interval longer than the first feed interval, and if the detecting unit has not detected the rear edge of the first sheet, said control section sets the second detecting timing by adding a conveyance malfunction detecting time for the first image forming mode to detect a conveyance malfunction of the first sheet to the first detecting timing if the image forming section forms an image on the second sheet in the first image forming mode and the second sheet has not started to be conveyed at the first detecting timing, and by adding a conveyance malfunction detecting time for the second image forming mode longer than the conveyance malfunction detecting time for the first image forming mode to the first detecting timing if the image forming section forms an image on the second sheet in the second image forming mode and the second sheet has not started to be conveyed at the first detecting timing.

4. The image forming apparatus as claimed in claim 1, wherein said control section decides a conveyance malfunction of the first sheet if the detecting unit has not detected the rear edge of the conveyed sheet at the second detecting timing.

5. The image forming apparatus as claimed in claim 1, further comprising: an image forming section for forming an image on the conveyed sheet; and a feed section for feeding a sheet stacked on the sheet stacking section to the image forming section, wherein the detecting unit is disposed on a conveyance path on which the sheet is conveyed from the sheet stacking section to the image forming section.

6. The image forming apparatus as claimed in claim 1, wherein said control section continues a conveyance of the first sheet if a rear edge of the first sheet has been detected after the first detecting timing until the second detecting timing when the first sheet is conveying.

7. The image forming apparatus as claimed in claim 1, wherein said control section stops a conveyance of the first sheet if a rear edge of the first sheet has not been detected after the first detecting timing until the second detecting timing when the first sheet is conveyed.

8. The image forming apparatus as claimed in claim 1, wherein the second detecting timing is a timing to detect the rear edge of the first sheet.

9. An image forming apparatus comprising:

a sheet stacking section that holds sheets on which an image is to be formed;

a detecting unit that detects a conveyed sheet; and a control section that receives information related to the size of a sheet stacked on the sheet stacking section and sets a first detecting timing after time based on the information related to the size elapses subsequent to detecting a front edge of the conveyed sheet stacked on the sheet stacking section and sets a second detecting timing after the first detecting timing to detect a conveyance malfunction of the sheet, wherein said control section sets a first prescribed value for the second detecting timing if a second sheet successively conveyed after a first sheet has started to be conveyed when the detecting unit does not detect a rear edge of the first sheet at the first detecting timing, and sets a second prescribed value greater than the first prescribed value for the second detecting timing if a second sheet successively conveyed after a first sheet has not started to be conveyed when the detecting unit does not detect a rear edge of the first sheet at the first detecting timing.

10. An image forming apparatus comprising:

a sheet stacking section that holds sheets on which an image is to be formed;

a detecting unit that detects a conveyed sheet; and a control section that receives information related to the size of a sheet stacked on the sheet stacking section and sets a first detecting period after time based on the information related to the size elapses subsequent to detecting a front edge of the conveyed sheet stacked on the sheet stacking section and sets a second detecting period after the first detecting period to detect a conveyance malfunction of the sheet, wherein said control section sets a first prescribed value for the second detecting period if a second sheet successively conveyed after a first sheet has started to be conveyed when the detecting unit does not detect a rear edge of the first sheet at the first detecting period, and sets a second prescribed value greater than the first prescribed value for the second detecting period if a second sheet successively conveyed after a first sheet has not started to be conveyed when the detecting unit does not detect a rear edge of the first sheet at the first detecting period.

* * * * *